United States Patent [19]

Mai

[11] Patent Number: 5,069,445

[45] Date of Patent: Dec. 3, 1991

[54] FOOT AND LEG EXERCISE DEVICE

[76] Inventor: Phuong N. Mai, 4343 Denham St. #401, Baton Rouge, La. 70805

[21] Appl. No.: 581,914

[22] Filed: Sep. 13, 1990

[51] Int. Cl.[5] ..... A63B 23/04

[52] U.S. Cl. ..... 272/96; 272/66

[58] Field of Search ..... 272/66, 70, 96, 97, 272/137, 138, 141; 128/25 R, 25 B

[56] References Cited

U.S. PATENT DOCUMENTS

| | | | |
|---|---|---|---|
| 2,107,447 | 2/1938 | Marlowe | 128/25 R |
| 3,498,606 | 3/1970 | Bostrom et al. | 272/66 |
| 3,526,220 | 9/1970 | Small | 272/96 |
| 3,814,420 | 6/1974 | Encke | 272/66 |
| 4,111,416 | 9/1978 | Jinotti . | |
| 4,573,678 | 3/1986 | Lamb et al. | 272/70 |
| 4,804,180 | 2/1989 | Salaz . | |

FOREIGN PATENT DOCUMENTS

| | | | |
|---|---|---|---|
| 242753 | 2/1987 | Fed. Rep. of Germany | 272/66 |
| 253372 | 1/1988 | Fed. Rep. of Germany | 272/66 |

*Primary Examiner*—Richard J. Apley
*Assistant Examiner*—Jerome W. Donnelly

[57] ABSTRACT

A foot-leg exercise device that includes two foot-supporting platforms individually swingably connected to the base structure. A spring within each platform provides resistance against downward deflection of the platform by the person's foot. Spring resistance can be varied by a manual screw adjustment means associated with each platform.

2 Claims, 1 Drawing Sheet

FOOT AND LEG EXERCISE DEVICE

BACKGROUND AND SUMMARY OF THE INVENTION

This invention relates to an exercise device that can be used by a person to strengthen his/her leg and foot muscles. The device comprises a base structure placeable on the floor, and two platforms that are hingedly connected to the base structure for swinging motions around a horizontal axis near one edge of the base structure. Each platform has an internal spring means for normally biasing the platform upwardly to an inclined position. The two platforms are spaced apart so that the person can stand with one foot on each platform. The platforms are individually depressible to horizontal positions by exerting pressure thereon through the muscles of the feet and ankles.

This exercise device will be helpful to any person desiring to increase muscular development in his/her feet or ankles, especially athletes desiring to jump higher and/or run faster.

The device of this invention is somewhat like the device shown in U.S. Pat. No. 4,111,416 to W. Jinotti. The Jinotti device includes a foot-supporting platform having a coil spring means therein. The spring is non-adjustable, such that the device cannot be set for effective use by different persons having different muscle strengths. My invention contemplates the use of an adjustable strength spring means in each platform, whereby the device can be used by different persons, and by persons for prolonged periods while their muscle strength is developing (changing).

U.S. Pat. No. 4,804,180 shows an exercise device that includes a swingable foot pedal having a tension coil spring associated therewith. Opposite ends of the coil spring can be inserted into selected holes in a first stationary angle iron and spaced holes in a second angle iron attached to the foot pedal. By inserting the spring ends into different holes it is possible to vary the spring tension and thus the resistance offered by the pedal to downward foot pressure. One problem with the arrangement of U.S. Pat. No. 4,804,180 is that the spring will usually be under considerable tension so that the process of removing the spring ends from the holes and attaching them to different holes is not easily accomplished. Also, there is the danger that during the process of removing or attaching the springs the person might temporarily loosen his grip on the spring so as to be injured by a fast-moving spring end. My invention contemplates the use of screw-actuated adjustment devices for the springs; adjustment of the spring force is easily accomplished by turning a manual adjustment knob connected to the screw. There is no need to manually readjust the spring location, as in the device of U.S. Pat. No. 4,804,180.

THE DRAWINGS

DESCRIPTION OF A PREFERRED EMBODIMENT OF THE INVENTION

Figure 1:
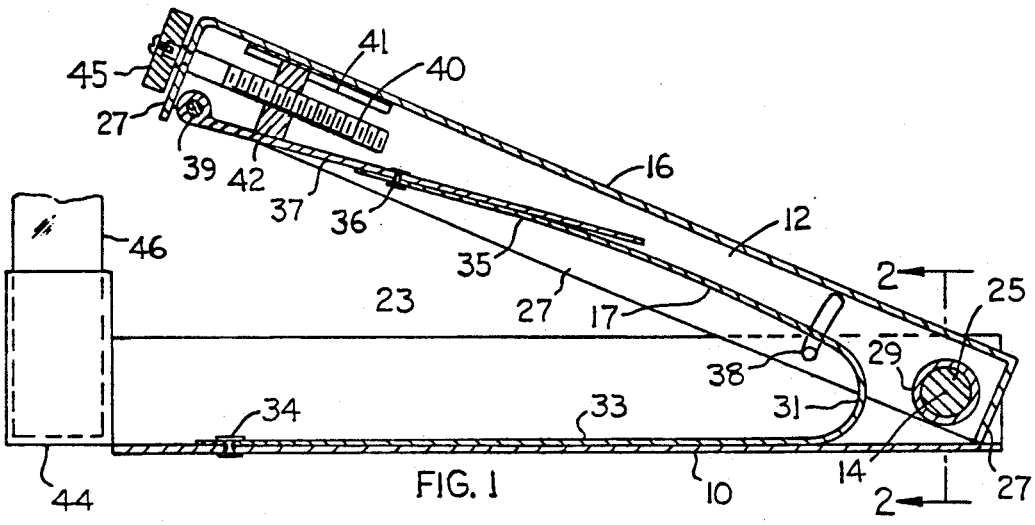
FIG. 1 is a sectional view taken on line 1—1 in FIG. 2, and showing the principal features of an exercise device embodying my invention.

The drawings show a foot-leg exercise device that includes a base structure 10 and two similarly constructed platforms 12. Each platform is swingably connected to the base structure for movement around a horizontal axis 14. As shown in FIG. 1, the representative platform 12 is in its normal at-rest position wherein its main plate section 16 is inclined in a right-to-left position. When manual foot pressure in applied to the upper surface of plate section 16 the platform is depressed to a generally horizontal position. A leaf spring 17 associated with the platform returns it to the FIG. 1 position when manual force on the platform is removed or lessened appreciably.

Figure 2:
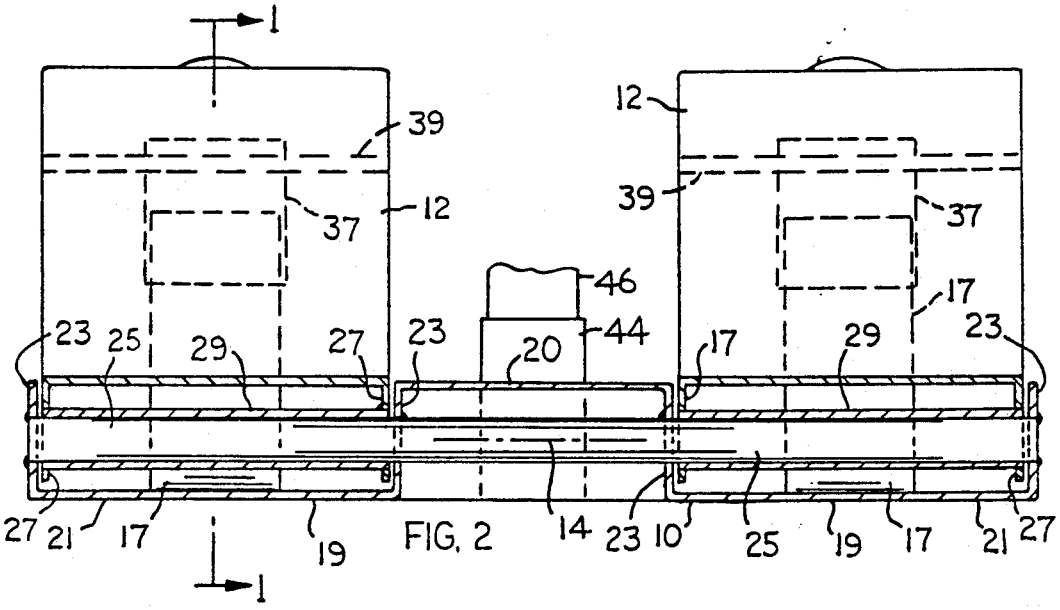
FIG. 2 is a sectional view taken on line 2—2 in FIG. 1.

Base structure 10 is best seen in FIG. 2. The base structure comprises two parallel upwardly-facing channels 19 and an interconnecting wall 20 therebetween. Each channel includes a web wall 21 and two upwardly-extending flanges 23. Wall 20 extends between the inner flanges 23 on the respective channels. Base structure 10 can be formed as a steel stamping.

The hinge connection between base structure 10 and the two platforms 12 includes an elongated steel rod 25 extending transversely through and between the flanges on channels 19; the rod may be welded to each flange so that the rod and channels act as mutual reinforcements. Each platform 12 comprises the aforementioned plate 16 and four downwardly-extending flanges 27 at edge areas of the plate. A circular sleeve 29 has its opposite ends welded to opposed ones of flanges 27 in encircling relation to fixed rod 25, thereby forming a hinge connection between the base structure and the platform. Instead of a single rod 25, there could be two shorter rods extending between the flanges of each channel 19.

Leaf spring 17 includes a central curved U-section 31 and two leg sections 33 and 35. Leg section 33 may be connected to base structure 10 by means of a rivet 34. Leg section 35 may be connected to a flat paddle 37 by means of a rivet 36. The paddle is swingably connected to the associated platform 12 by means of a rod 39 extending between opposed ones of flanges 27.

The position of paddle 37 can be manually adjusted by a rotary screw 40 that extends through a platform flange 17 into an internally threaded nut 42 that is guided in a channel 41. A manual knob 45 is carried on the screw for turning purposes. As the screw is turned the nut 42 is advanced to the left or to the right (depending on the direction of turn), thereby swinging paddle 37 to different adjusted positions.

Leg section 33 of the spring exerts a downward force on base structure 10, whereas leg section 35 exerts an upward force on platform 12. Paddle 37 applies an at-rest restraining force on leg section 35, which varies according to the paddle position (determined by screw 40). The system is such that the effective upward force of spring 17 in the at-rest position of platform 12 (FIG. 1) is variable, whereby the resistance of the platform to downward foot pressure is variable in accordance with the muscular developments of different persons who might have occasion to use the exercise device. Upward movement of each platform 12 is limited by a pin 38 extending from associated wall 23 through a slot in flange 17 of the platform.

The exercise device can include a hand grip cross bar located at waist height in front of the person while he/she is standing on platforms 12, 12. As shown in the drawings, a socket 44 is attached to base structure 10 for supporting a vertical post 46 that carries the desired cross bar (not visible in the drawings).

I claim:

1. A foot-leg exercise device, comprising a base structure; two platforms hingedly connected to said base structure for swinging motions around a horizontal axis, each platform including an upwardly-facing foot-accommodating plate adapted to move between a normal inclined position and a depressed horizontal position; said platforms being laterally spaced apart on the base structure whereby a person can simultaneously have one foot on each platform; a spring means located between each platform and the base structure for biasing the associated platform to its normal inclined position; and a screw-actuated adjustment means for varying the at-rest pressure exerted by each spring means on the associated platform; each said spring means comprising a leaf spring having a curved U-section and two leg sections extending therefrom, one leg section being oriented to exert a downward force on the base structure, the other leg section being oriented to exert an upward force on the associated platform; each said adjustment means comprising a paddle swingably connected to the free end of the associated platform, each said paddle having a free end portion thereof connected to said other leg section of the leaf spring to exert a downward restraining force thereon.

2. The exercise device of claim 1, wherein each said adjustment means further comprises a manually rotatable screw and travelling nut carried on the platform to adjust the position of the associated paddle; said nut being interposed between opposed surfaces of the platform and paddle for movement along the paddle surface.

* * * * *